US008360795B2

(12) United States Patent
Moore

(10) Patent No.: US 8,360,795 B2
(45) Date of Patent: Jan. 29, 2013

(54) POWER CONNECTION SYSTEM AND METHOD

(76) Inventor: Harold G. Moore, Staunton, VA (US)

( * ) Notice: Subject to any disclaimer, the term of this patent is extended or adjusted under 35 U.S.C. 154(b) by 0 days.

(21) Appl. No.: 12/909,474

(22) Filed: Oct. 21, 2010

(65) Prior Publication Data

US 2012/0100741 A1 Apr. 26, 2012

(51) Int. Cl.
*H01R 4/50* (2006.01)

(52) U.S. Cl. ..... 439/342

(58) Field of Classification Search ..... 439/342, 439/341, 505, 357–358, 668, 289, 350–353
See application file for complete search history.

(56) References Cited

U.S. PATENT DOCUMENTS

| | | | | |
|---|---|---|---|---|
| 2,369,860 | A * | 2/1945 | Schroeder | 439/289 |
| 4,869,681 | A | 9/1989 | Vache et al. | |
| 5,104,331 | A * | 4/1992 | Goble | 439/341 |
| 5,399,102 | A * | 3/1995 | Devine | 439/505 |
| 5,639,256 | A * | 6/1997 | Endo et al. | 439/358 |
| 5,934,911 | A * | 8/1999 | Stout et al. | 439/21 |
| 6,022,237 | A * | 2/2000 | Esh | 439/348 |
| 6,910,911 | B2 * | 6/2005 | Mellott et al. | 439/358 |
| 7,303,420 | B2 * | 12/2007 | Huch et al. | 439/341 |
| 7,442,060 | B2 * | 10/2008 | Suwalski et al. | 439/180 |
| 7,722,377 | B2 * | 5/2010 | Moore | 439/341 |
| 8,079,880 | B2 * | 12/2011 | Lin et al. | 439/668 |
| 2009/0286415 | A1 | 11/2009 | Moore | |

FOREIGN PATENT DOCUMENTS

JP 2005-177363 A 7/2005

OTHER PUBLICATIONS

International Search Report dated Apr. 25, 2012 from corresponding International Patent Application No. PCT/US2011/057310—4 pages.

* cited by examiner

*Primary Examiner* — Jean F Duverne
(74) *Attorney, Agent, or Firm* — Maier & Maier PLLC

(57) ABSTRACT

The power connection system for a power tool includes a housing defining a recess, a plurality of electrical connector guide grooves, an electric motor connected to a tool member, an electric circuit connected to the motor, and arcuate electrical contact prongs disposed in the recess. The power cord has complementary arcuate receptacles that can be removably engageable with the prongs in a desired manner, the cord being connectable to a power source to connect the power tool to the power source, and a lock pin that locks the power cord to the housing. The power cord may be universally connected to any power tool having a similar recess with arcuate prongs.

7 Claims, 6 Drawing Sheets

POWER CONNECTION SYSTEM AND METHOD

CROSS-REFERENCE APPLICATIONS

The present invention is related to U.S. Pat. No. 7,722,377, issued on May 25, 2010 entitled POWER CONNECTION SYSTEM, the disclosure of which is incorporated by reference herein in its entirety.

BACKGROUND

A power tool generally includes a housing with an electric motor disposed therein, the electric motor driving a tool element, such as, e.g., a reciprocating sanding member. The motor is electrically connected to an electrical power source by a power cord. Typically, the power cord is directly wired to the electrical circuit of the motor, such as to the on/off switch, and is non-irremovably fixed to the housing or handle of the power tool.

One problem with the above-described power tool is that, if the power cord is damaged or accidentally severed during operations, a cord must be rewired to the electrical circuit. In order to rewire the new cord, the handle of the power tool must be disassembled so that the new cord can be directly wired to the on/off switch. Alternatively, if a sufficient length of the damaged cord is still connected to the power tool, a new plug can be rewired to the severed end of the cord. In either event, rewiring of the power cord is time consuming and inconvenient. Moreover, suitable cords and plugs may not be readily available at a work site for replacement of or attachment to the damaged cord.

Another problem with the above-described power tool is that, occasionally, an operator will suspend the power tool by the cord. If the cord is not properly and securely connected to the power tool, the body of the power tool can separate from the cord and fall, possibly injuring another worker or damaging the power tool. Moreover, a non-universal power connection system is generally limited to a specific tool and does not facilitate interchangeability of a power cord with other tools

SUMMARY

A power connection system for a powered device may be described in some exemplary embodiments. The power connection system can include a power tool having a housing defining a recess; a first arcuate electrical contact member and at least a second arcuate electrical contact member extending into the recess, the first arcuate electrical contact member and the at least second arcuate electrical contact member electrically connected to a power circuit of the power tool; an elongated power cord having a plug at one end and an opposite end having a power delivery head, the power delivery head having a first arcuate electrical contact member and at least a second arcuate electrical contact member disposed therein, the first arcuate electrical contact member of the power delivery head removably mating with the first arcuate electrical contact member of the housing first and the at least second arcuate electrical contact member of the power delivery head removably mating with the at least second arcuate electrical contact member of the housing second to deliver power to the power tool when the plus is connected to a power source; and a lock pin insertable through the power tool housing and the power delivery head to lock the power delivery head to the power tool.

In another exemplary embodiment, a power connection system for a powered device may be described. The power connection system can have a retrofit body having a housing defining a recess and a first electrical conductor and at least a second electrical conductor, the first and at least second electrical conductors extending outside the retrofit body; a first arcuate electrical contact member extending into the recess and at least a second arcuate electrical contact member extending into the recess, the first and at least second arcuate electrical contact members connected to the first electrical conductor and the at least second electrical conductor, respectively; a pivotal joint located proximate the first arcuate electrical contact member; and a power delivery head, the power delivery head having a third arcuate electrical contact member and at least a fourth arcuate electrical contact member the third and at least a fourth arcuate electrical members coupled to a power source and removably mateable with the first and at least second electrical contact members, respectively, the power delivery head further having pivot pin located proximate the third arcuate electrical contact member.

In still another exemplary embodiment, a method for safely removably coupling a power source with a powered device may be described. The method can include steps for disposing a plurality of female electrical connectors with a ground located in a first position linearly on a housing of a powered device; disposing a plurality of male electrical connectors with a ground located in a first position linearly on a housing of a power source; connecting the housing of the powered device to the housing of the power source with a pivot and pivot pin; rotating the connected housing of the powered device to the housing of the power source; coupling the ground of the plurality of the female electrical connectors with the ground of the plurality of male electrical connectors; and coupling remaining connectors of the plurality of female electrical connectors with remaining connectors of the plurality of male electrical connectors.

DETAILED DESCRIPTION

Figure 1:
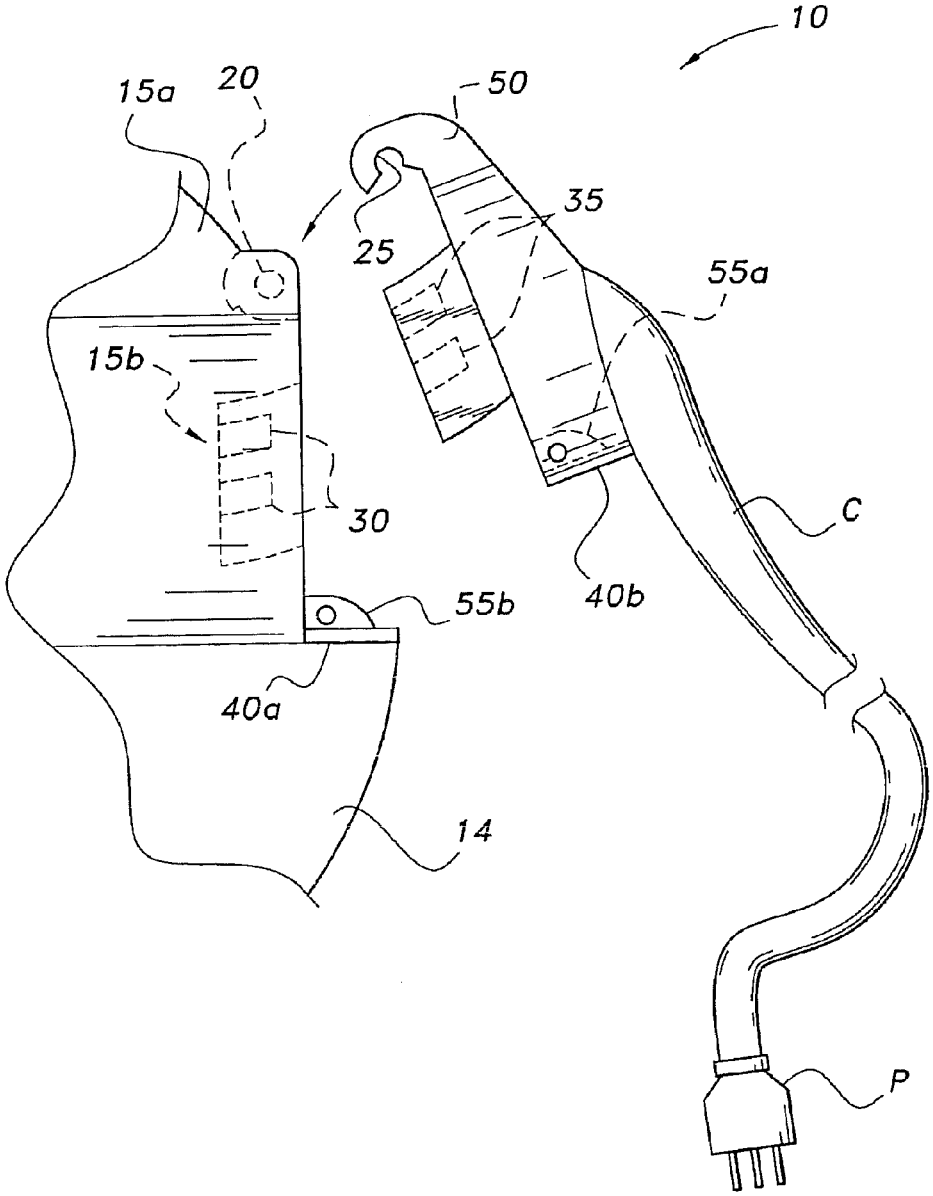
FIG. 1 is an environmental side view of a power tool having a power connection system according to some exemplary embodiments.
Figure 3:
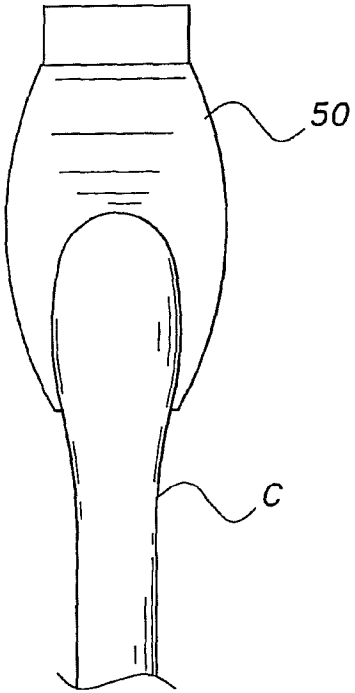
FIG. 3 is an environmental top view of a power tool having a power connection system including an attached power cord.
Figure 2:
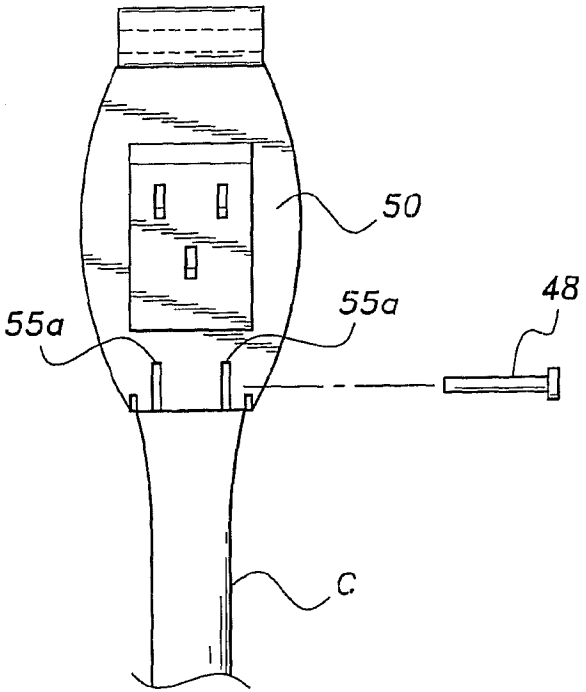
FIG. 2 is a front view of a receptacle portion of a power connection system according to some exemplary embodiments.
Figure 4:
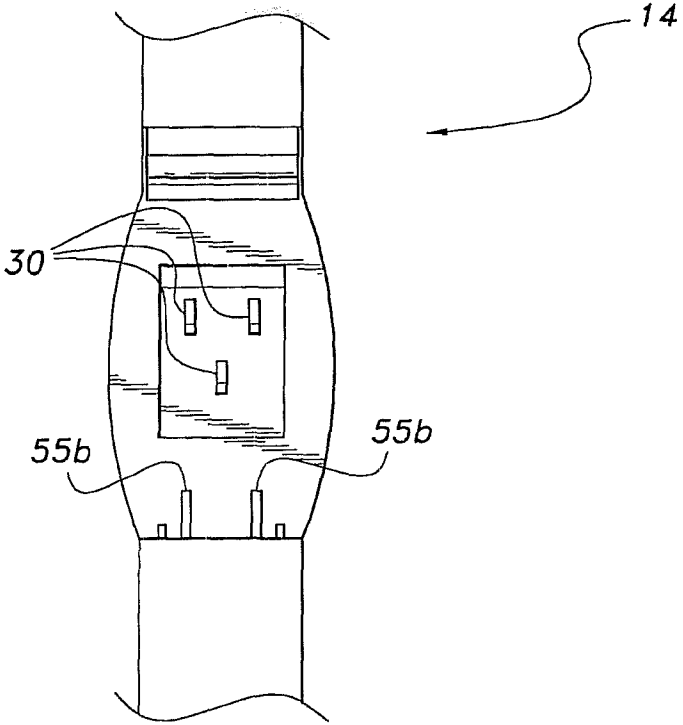
FIG. 4 is a front view of a power tool equipped to receive a cord of the power connection system according to some exemplary embodiments.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

The power connection system provides a power cord and base removably connectable to each other. The power cord can be positively locked to the base, which is defined in a housing of a power tool, to prevent the power cord from being inadvertently disconnected from the electrical circuit and from the housing of the power tool. In particular, the cord and base provide a power connection system for a power tool in which the power tool has a housing defining a recess and a plurality of electrical connector guide grooves, an electric motor disposed in the housing and operable to drive a tool member, and an electrical circuit connected to the motor. The power cord is connectable to the base defined in the housing and operable to connect the tool to an A.C. power source. The power cord is quickly and easily removable and replaceable if the cord is damaged or severed. Moreover, the power cord is interchangeable with other power tools equipped having a universal base adapted for the cord.

A power tool, including a curved prong adaptor and removable power cord 10 embodying the invention, is illustrated in FIGS. 1-4. In the illustrated construction, the power tool may be any type of tool 14, such as a sander, a drill, reciprocating saw, or the like.

The power tool 14 includes a motor housing having a handle portion 15*a*. An electric motor is disposed in the housing of tool 14 and is operable to drive a tool member, such as a sanding member, drill, or saw. The motor can be electrically connected by an electrical circuit to an on/off switch disposed on the tool 14. The circuit includes arcuate electrical connecting prongs 30 defined in the base for connection with the power cord C.

A recessed portion 15*b* of the handle portion 15*a* defines the base, which provides an enclosure for the arcuate electrical connecting prongs 30. The recessed portion 15*b* supports the power cord C when the power cord C is connected to the housing 14. The power cord 10 includes a plurality of wires, preferably including a hot wire, a neutral wire, and a ground wire having, for example, a conventional three-prong plug P at one end and a clamshell-shaped receptacle 50 at the opposite end, the wires being disposed in an insulated jacket. The tool 14 includes a plurality of electrical connector guide grooves 40*a*, which mate with complementary ridges 40*b* disposed on the power head, i.e., clamshell receptacle 50.

The clamshell receptacle 50 of power cord C includes an electrical receptacle having arcuately curved slots 35 having contacts electrically connected to the conductive wires of the cord C. The arcuately curved slots 35 are designed to receive the arcuately curved prongs 30 as the clamshell receptacle 50 is snapped onto and pivoted into the recess 15*b* in the handle portion 15*a* of power tool 14 to provide the tool with electrical power.

The clamshell receptacle 50 has a pivotal joint 25 that engages pivot bar 20 of tool handle portion 15*a*. Complementary grooves 40*a* and 40*b* laterally constrain clamshell receptacle 50 as it pivots into the tool 14. Clamshell receptacle 50 and recess 15*b* also have sets of complementary eyelets 55*a* and 55*b*, respectively. During a connecting procedure by a user, clamshell receptacle eyelets 55*a* are aligned with tool handle eyelets 55*b* and secured by lock pin 48, the lock pin 48 being pushed into the aligned eyelets 55*a* and 55*b*.

Figure 5:
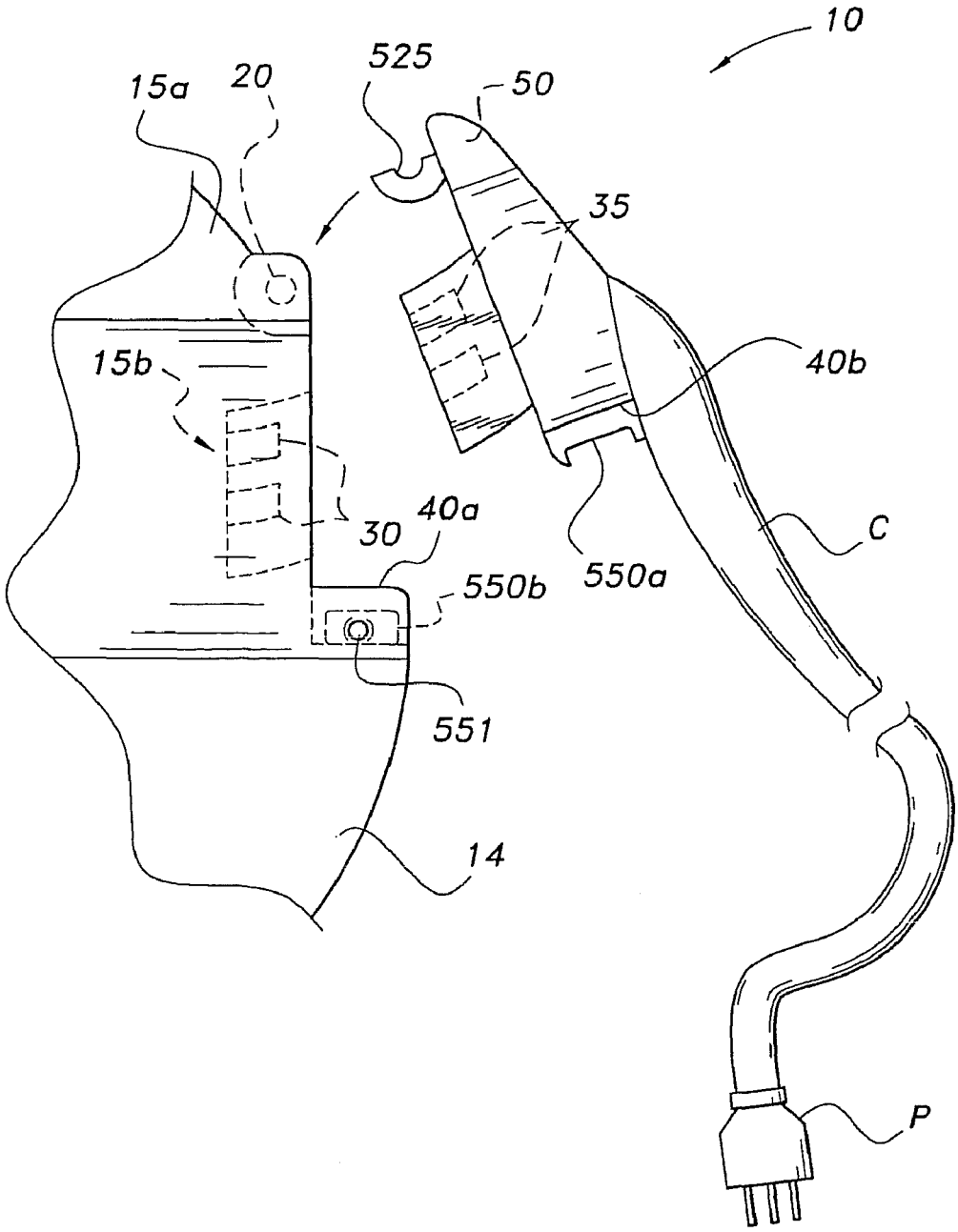
FIG. 5 is a side view of a power tool having a power connection system according to some exemplary embodiments, including an alternative cord locking feature.

As shown in FIG. 5, alternative pivotal joint 525 of receptacle/power head 50 may be a crescent-shaped, concave member that can directly contact cylindrical pivot bar 20 of tool handle portion 15*a*, rather than hooking around the bar 20 as the aforementioned pivotal member 25 does. Moreover, alternatively to alignment eyelets 55*a* and 55*b*, removable power head member 50 may have a substantially C-shaped hook 550*a* that removably locks into complementary rectangular head 550*b* of lock pin 551. Lock pin 551 is slidable along its axis within recess 15*b*. A cavity inside the recess 15*b* allows the lock pin 551 to slidably engage or disengage the head 550*b* of pin 551 with hook 550*a* to lock and alternatively unlock the removable receptacle 50 from the recess portion 15*b* of tool 14.

Figure 6:
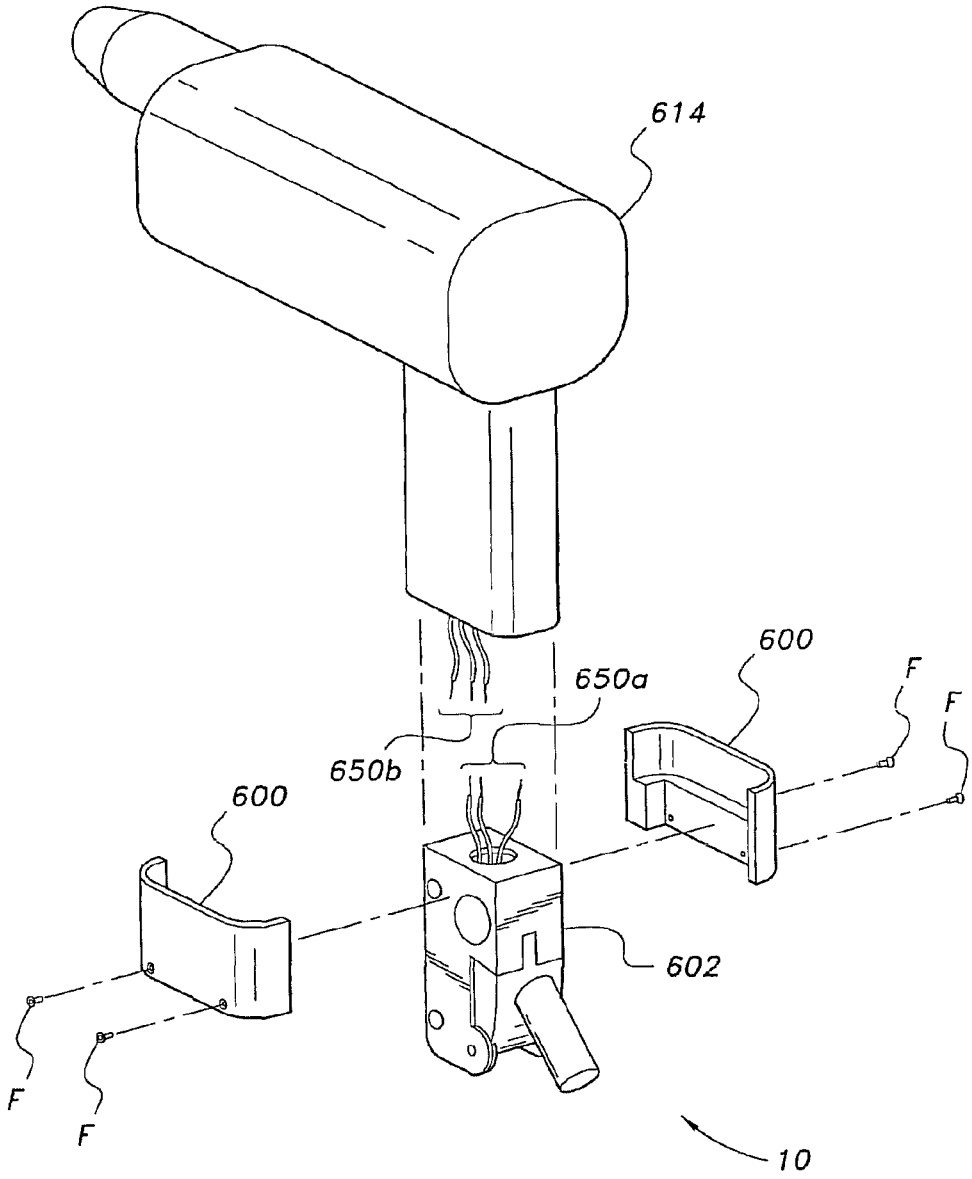
FIG. 6 is a partially exploded, perspective view of a power tool equipped to receive a power cord of the power connection system according to some exemplary embodiments.

As shown in FIG. 6, the removable power cord system 10 may be packaged as a retrofit unit 602 that can be attached to a power tool 614. Power supplying leads 650*a* are electrically connected (via pig tailing, crimping, soldering, circuit board leads, or any other method known by a person having ordinary skill in the art) to power receiving leads 650*b* of power tool 614. The retrofit unit 602 can be secured to the tool 614 by any means known to persons having ordinary skill in the art. As shown in FIG. 6, the retrofit unit 602 is secured to the tool 614 by retaining collars 600, which are held together by fasteners F.

The power cord C may be easily removed and replaced if damaged during cutting operations. Also, the power cord C is positively locked to the power tool to ensure a conveniently removable electrical and physical connection 10 of the power cord C and the power tool 14.

It will be understood that the arcuate prongs may extend from the power cord and the arcuate slots may be defined in the power tool housing, if desired.

Figure 7A:
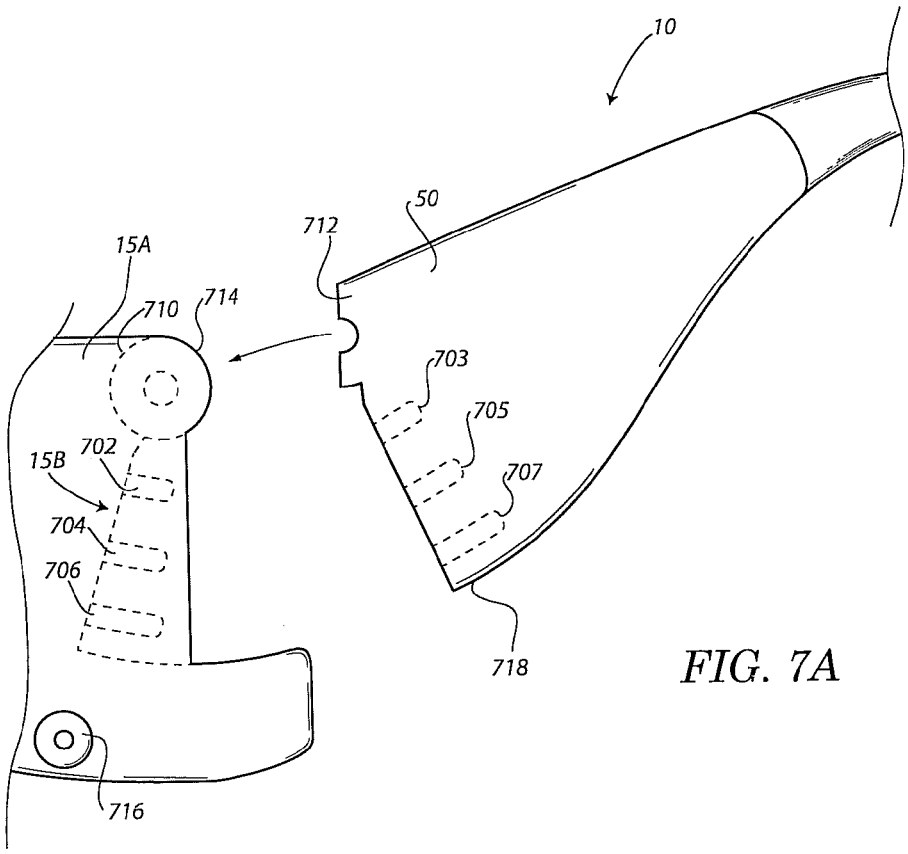
FIG. 7A is an environmental side view of a power tool having a power connection system according to some exemplary embodiments.
Figure 7B:
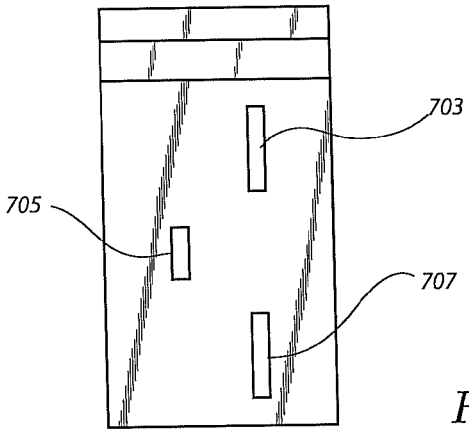
FIG. 7B is a front view of a receptacle portion of a power connection system according to some exemplary embodiments

In still another exemplary embodiment using arcuous ground connection systems with a powered device and referring now to exemplary FIGS. 7A and 7B, a number of electrical contact members may be described and shown. Here, electrical contact members may be referred to as prongs and slots, for example receiving slots. For example a prong, such as prong 702, may be a ground prong, and prongs 704 and 706 may be current carrying or neutral prongs. Prong 702 may further be curved or arcuate, for example curved in a complimentary fashion in recess 15*b* of handle portion 15*a* of a powered device that mates with slot 703 of receptacle 50. Additionally, as shown in exemplary FIGS. 7A and 7B, prongs 702, 704 and 706 may be disposed linearly, substantially linearly or offset on receptacle 50, for example with prong 702 disposed in a top position, prong 704 disposed in a middle position (either linearly or offset) and prong 706 disposed in a bottom position. Additionally, prongs 702, 704 and 706 may be arranged in different orientations, as desired.

In some alternative exemplary embodiments, receptacle 50 may be such that only two prongs are utilized. In such exemplary embodiments, handle portion 15*a* and recess 15*b* may be similarly equipped with two recesses. Thus, in such exemplary embodiments, a top prong, such as prong 702, may still be mated with a top recess, such as recess 703, prior to the mating of a second prong with a second recess and the top prong may be a ground. Additionally, any orientation of any number of prongs and recesses may be utilized in any of the exemplary embodiments described herein. For example, in a three prong and three recess embodiment, the prongs and recesses may be arranged linearly or substantially linearly. Additionally, the prongs and recesses may be in an offset or substantially triangular orientation, as is known in the art. Still other orientations of corresponding prongs and recesses may be appreciated or utilized as desired. Additionally, the prongs and recesses may be formed in any size and shape, as is known in the art. For example, prongs may be round or substantially square and recesses may be shaped in an accommodating fashion.

Thus, in some exemplary embodiments and using the orientation of prongs as shown in exemplary FIGS. 7A and 7B, prong 702 may mate with receptacle 50 prior to prongs 704 and 706 when connecting, mating or coupling handle portion 15*a* with receptacle 50 and prong 702. Additionally, when disconnecting or unmating receptacle 50 with handle portion 15*a*, current carrying prongs 704 and 706 may be disconnected from slots 705 and 707, respectively, prior to ground prong 702 being disconnected from slot 703. Thus, while all prongs may remain covered during connection and disconnection of handle 15*a* and receptacle 50, any risk of electrical shock may further be reduced by connecting ground prong 702 with slot 703 prior to the connection of current carrying prongs, or 704 and 706 and disconnecting ground prong 702 after the disconnection of current carrying prongs 704 and 706.

In some other exemplary embodiments and similar to those described previously, clamshell receptacle 50 may utilize any form of pivotal joint 712, for example those shown in other figures, that can allow for receptacle 50 to be connected with handle portion 15*a* and recess 15*b*, including prongs 702, 704 and 706. Similarly, handle portion 15*a* of power tool 14 can have any type of receiving end 714, such as a pivot bar described in previous embodiments, that it may be connected or coupled to and which allow prongs 702, 704 and 706 to be coupled with slots 703, 705 and 707, respectively, as described above. Also, any type of locking members 716 and 718 may be utilized as desired and as described herein.

Thus, and further to the exemplary embodiments described above, any size, orientation or shape prongs, handle portion or receptacle may be used or formed that can allow for a ground prong to be inserted into a slot first or removed from a slot last when coupling a power cord to a device to be powered. This may allow for, in arcuous ground connection systems, an additional level of safety for any party who may use a powered device or who may connect or disconnect a powered device.

It is to be understood that the present invention is not limited to the embodiment described above, but encompasses any and all embodiments within the scope of the following claims.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A power connection system for a powered device, comprising:

a retrofit body having a housing defining a recess and a first electrical conductor and at least a second electrical conductor, the first and at least second electrical conductors extending outside the retrofit body;

a first arcuate electrical contact member extending into the recess and at least a second arcuate electrical contact member extending into the recess, the first and at least second arcuate electrical contact members connected to the first electrical conductor and the at least second electrical conductor, respectively;

a pivotal joint located proximate the first arcuate electrical contact member; and a power delivery head, the power delivery head having a third arcuate electrical contact member and at least a fourth arcuate electrical contact member the third and at least a fourth arcuate electrical members coupled to a power source and removably mateable with the first and at least second electrical contact members, respectively, the power delivery head further having pivot pin located proximate the third arcuate electrical contact member;

wherein the retrofit body is coupled to the power delivery head with the pivotal joint and the pivot pin such that the removable mating of the first and at least second arcuate electrical contact members with the third and at least fourth arcuate electrical contact members, respectively, causes the first arcuate electrical contact member to mate with the third arcuate electrical contact member first when coupling the retrofit body to the power delivery head and the first arcuate electrical contact member to disconnect from the third arcuate electrical contact member last when decoupling the retrofit body and the power delivery head.

2. The power connection system for a powered device according to claim 1, wherein the first and at least second arcuate electrical contact members are slots.

3. The power connection system for a powered device according to claim 1, wherein the third and at least fourth arcuate electrical contact members are prongs.

4. The power connection system for a powered device according to claim 1, further comprising a third electrical conductor fifth electrical contact member connected to a third arcuate electrical contact member extending into the recess and a fifth arcuate electrical member on the power delivery head and coupled to the power source.

5. The power connection system for a powered device according to claim 4, wherein the coupling of the to the power delivery head with the pivotal joint and the pivot pin further causes the fifth arcuate electrical contact member to mate with the sixth arcuate electrical contact member.

6. The power connection system for a powered device according to claim 4, wherein the first, at least second and fifth arcuate electrical contact members are arranged in a substantially offset pattern.

7. The power connection system for a powered device according to claim 4, wherein the third, at least fourth and sixth arcuate electrical contact members are arranged in a substantially offset pattern.

* * * * *